United States Patent [19]

Pohn et al.

[11] Patent Number: 5,044,151

[45] Date of Patent: Sep. 3, 1991

[54] YARN DRAW-OFF PIPE TO DRAW OFF A YARN FROM AN OPEN-END SPINNING DEVICE

[75] Inventors: Johann Pohn; Rudolf Oexler; Gottfried Schneider; Edmund Schuller; Ernst Domke, all of Ingolstadt, Fed. Rep. of Germany

[73] Assignee: Schubert & Salzer Maschinenfabrik Aftiengesellschaft, Ingolstadt, Fed. Rep. of Germany

[21] Appl. No.: 207,741

[22] Filed: Jun. 16, 1988

[30] Foreign Application Priority Data

Jun. 25, 1987 [DE] Fed. Rep. of Germany ..... 3720967

[51] Int. Cl.[5] ..... D01H 4/40

[52] U.S. Cl. ..... 57/417

[58] Field of Search ..... 57/404, 408, 413–417

[56] References Cited

U.S. PATENT DOCUMENTS

| | | | |
|---|---|---|---|
| 4,258,541 | 3/1981 | Le Chatelier et al. | 57/417 |
| 4,499,719 | 2/1985 | Faessler | 57/417 |
| 4,516,397 | 5/1985 | Raasch et al. | 57/417 |
| 4,625,506 | 12/1986 | Beckers | 57/413 |
| 4,665,687 | 5/1987 | Ott et al. | 57/417 |
| 4,773,211 | 9/1988 | Stahlecker et al. | 57/417 |

*Primary Examiner*—Joseph J. Hail, III

*Attorney, Agent, or Firm*—Dority & Manning

[57] ABSTRACT

A yarn draw-off pipe for drawing off a yarn from an open-end spinning device. The draw-off pipe is equipped with first and second pipe sections, which are connected to each other through a connecting piece. The connecting piece contains a chamber and is provided with a deflection surface extending into the chamber. The latter is part of an insert. The connecting piece is provided with an insertion opening for this insert on its side towards the spinning element, when assembled, the insert is secured axially between the front end of the insertion opening and the first pipe section or, alternatively, between the two pipe sections. The insert is made of a ceramic material and, with its end towards the spinning device, projects radially beyond the outside diameter of the first pipe section. The area of the guide left free by the insert is filled with a plastic material.

74 Claims, 2 Drawing Sheets

YARN DRAW-OFF PIPE TO DRAW OFF A YARN FROM AN OPEN-END SPINNING DEVICE

BACKGROUND OF THE INVENTION

The instant invention relates to a yarn draw-off pipe for drawing off yarn from the spinning element of an open-end spinning device. The pipe is equipped with first and second pipe sections connected to each other by a connecting piece which contains a chamber. The connecting piece is provided with a deflection surface extending into the chamber.

In a prior art yarn draw-off pipe, the deflection surface is part of a wall which is attached in a connecting piece containing a chamber (See German Patent No. DE-Gm 7.341.112). The second pipe section lets out at an angle to the cylindrical chamber of the connecting piece. If at all possible, in such a device, it is only with great difficulty that the deflection surface extending into the path of the yarn can be assigned to any extent to the second pipe section, so that the path of the yarn within the connecting piece, and thereby, also the effect of the deflection surface upon the yarn, varies greatly from one yarn draw-off pipe to another.

SUMMARY OF THE INVENTION

It is, therefore, the object of the invention to provide a yarn draw-off pipe that can be reproduced easily, and always in the same manner.

This object is attained through the invention in that the deflection surface is part of an insert and the chamber is provided with an insertion opening on its side facing the feeding side when assembled, the insertion being secured axially between the front end of the insertion opening and the first pipe section, or alternately, between the first and the second pipe section. Such a configuration makes it possible to obtain secure and precise immobilization of the insert within the connecting piece while keeping the assembly of the fiber draw-off pipe simple, so that the deflection surface acts in a precisely adjustable manner upon the yarn being drawn off. The yarn draw-off pipe can be produced easily, since it consists of simple basic pieces.

In a preferred embodiment, in which the insert is secured axially by the two pipe sections, the chamber widens in the longitudinal sense of the insert and the latter is axially adjustable in its relation to the connecting piece through the adjustment of at least one of the two pipe sections, or it can be replaced by an insert of a different length. During the assembly, it is possible to adjust the intensity of the effect of the deflection surface on the yarn by changing the relative positions between connecting piece on the one hand, and the pipe sections, as well, as the insert, on the other hand.

In addition, or as an alternative, provisions can be made in one embodiment, in which the chamber widens in the longitudinal sense of the insert, for the insert to extend more or less into the chamber so that the insert acts with greater or lesser intensity upon the yarn, depending on the type of yarn one wishes to produce.

In a further embodiment of the invention, the inside walls of the chamber are arranged, essentially, as a continuation of the bores of the two pipe sections. By contrast to the present state of the art, where sudden changes of diameter in the chamber area produce air turbulence which is very detrimental to the orderly back-feeding of the yarn into the spinning element for piecing, or which makes it impossible, an arrangement of the chamber walls essentially as a continuation of the bores of the two pipe sections ensures the reliable guidance of the yarn back to the spinning element so that the time required to feed the yarn back into the spinning element is precisely defined. Reliability of piecing is, thereby, increased.

To ensure longer life the insert is, preferably, made of a ceramic material.

The insert can be of different configurations, depending upon the effect one wishes to obtain. According to a preferred embodiment, the insert is provided with one or several edges protruding into the chamber. Preferably, this edge, or these edges, extend obliquely to the path of the yarn.

In a simple embodiment of the invention the two pipe sections are held in the connecting piece.

The connecting piece can be made in different ways. For example, it can be made of plastic, and provided with metal sleeves to receive the two pipe sections, each of which receives one end of the insert.

In a preferred embodiment of the invention, a portion of the interior walls of the chamber is simply constituted by the insert, while the remaining portion of the interior chamber walls is left open by the insert.

The insert must be given a position that is defined in its relation to the yarn, not only in the axial direction, but also in the circumferential direction of the chamber, so that the optimal effect of the insert upon the yarn being drawn off may be obtained. For this purpose, the insert is secured against rotation by means of a guide extending in the longitudinal direction of the connecting piece.

In a preferred embodiment of the invention, the guide extends parallel to the longitudinal axis of the first pipe section, which is the one closest to the spinning element, and ends in a bore serving to receive the second pipe section. In this way, the insert is immobilized in its exact position by the two pipe sections at both ends.

In order to achieve greatest possible deflection of the yarn, without subjecting it to excessive stresses, that would result in napping of the yarn, it is desirable for the guide to project radially, at its end, towards the spinning device, beyond the outer diameter of the first pipe section. The first pipe section is positioned eccentrically with respect to the connecting piece since this allows for compact construction. By filling the area of the guide left free by the insert with a plastic material, the interior of the yarn draw-off pipe in the area of the guide can be sealed perfectly, and by suitable curing of the plastic material it can also be made to contribute to the axial immobilization of the insert.

Preferably, the guide is limited by a wall of the connecting piece on its side away from the yarn path, as this facilitates the sealing of the chamber towards the outside. To secure the guide against rotation in this case, the guide is given a polygonal cross-section.

The yarn draw-off pipe, according to the invention, is simple in construction since it is composed of simple elements which can be assembled and attached in a simple manner. In addition, the insert can be brought easily into a defined position in its relation to the two pipe sections so that the action of the insert can be determined precisely. By avoiding unnecessarily protruding edges, and jumps in the diameters within the connecting piece, safe and rapid back-feeding of the yarn to the spinning device for piecing is ensured.

BRIEF DESCRIPTION OF THE DRAWINGS

Several embodiments of the invention are explained in greater detail, through the drawings, in which.

DETAILED DESCRIPTION OF THE DRAWINGS

Figure 1:
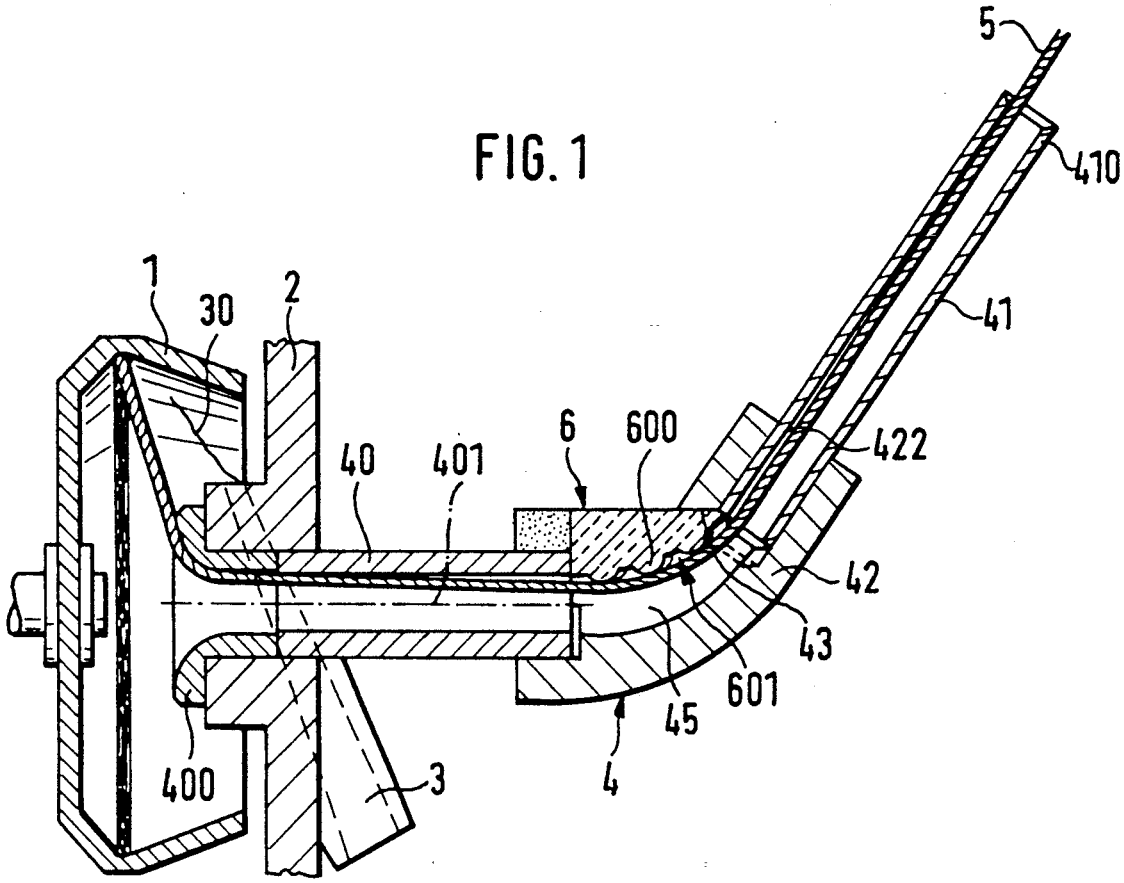
FIG. 1 shows a cross-sectional view of the yarn draw-off pipe, according to the invention, in combination with a rotor spinning device.
Figure 2:
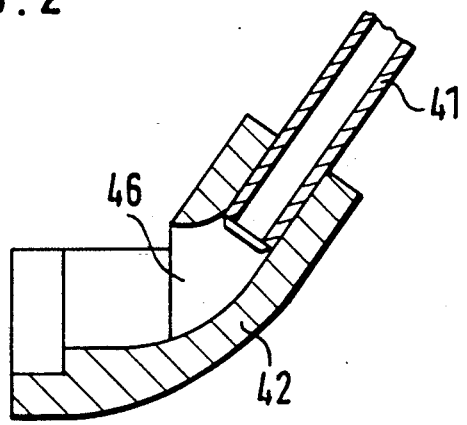
FIG. 2 shows a cross-sectional view of a modified embodiment of the invention.

FIG. 1 shows part of an open-end spinning device with a spinning element made in the form of a spinning rotor 1. Spinning rotor 1 is located in a housing (not shown) which is closed by a cover 2. A fiber feeding channel 3, through which fibers 30 are fed, in a known manner, into the spinning rotor 1, is installed in the cover. A yarn draw-off pipe 4, through which the fibers 30, twisted into the end of a yarn 5 are withdrawn, opens centrically into the cover 2. A fiber sliver is opened into fibers 30, as much as possible down to the individual fibers fed into the spinning rotor 1, and yarn 5 is drawn off from the spinning rotor 1, by conventional means, which are not shown.

The yarn draw-off pipe 4 is provided with a first pipe section 40 by means of which said yarn draw-off pipe 4 is held in cover 2. The yarn draw-off pipe 4 also has a second pipe section 41 which is installed at an angle in its relation to the first pipe section. The two pipe sections 40 and 41 are connected to each other by a connecting piece 42. The latter is provided with an insertion opening 46 on its feeding side, which faces the spinning rotor 1 when installed, to receive an insert 6 which is located on the inside curve of the connecting piece 42. The inside walls of the connecting piece 42, as well as the insert 6 limit in the radial direction, a chamber 45 which has essentially the same inside diameter as the two pipe sections 40 and 41 in the proximity of said pipe sections 40 and 41, which are applied against the two ends of insert 6 and, thus, secure it in the axial direction.

The insert 6 is provided with a deflection surface 601 which can have different configurations, for contact with yarn 5, on its side, towards chamber 45. According to FIG. 1, the deflection surface 601 is provided with one or several transverse ribs or edges 600.

During draw-off, yarn 5 is applied against the transverse rib or ribs or edges 600 of insert 6 and constitutes a twist brake, so that the twist being formed in the yarn segment between the inlet opening 400 of the yarn draw-off pipe 4 and the transverse ribs or edges 600 cannot, or can only with difficulty, propagate itself in the yarn segment between the transverse ribs or edges 600 and the yarn draw-off device (not shown). The yarn segment in pipe section 40, thereby, accepts greater twist, which is then propagated up to and into spinning rotor 1. This facilitates the incorporation of the fibers 30 into yarn 5. It is, therefore, not necessary, in order to obtain reliable incorporation of the fibers 30, for a high degree of twist to be imparted. Therefore, yarn draw-off pipe 4 makes it possible to produce softly twisted yarns.

Yarn draw-off pipe 4 not only serves to guide yarn 5, as it is drawn off from the spinning rotor 1, but in addition, also serves to guide yarn 5 during the piecing phase as it is fed back into the spinning rotor 1, so that it may combine therein with the fibers accumulating in spinning rotor 1. A negative spinning pressure is produced, in a conventional manner inside spinning rotor 1, taking effect through the yarn draw-off pipe 4 and also upon a yarn 5 which is introduced into the outlet end 410 of the pipe section 41. Since jumps or changes in diameter are avoided in the connecting piece 42, the end of a back-fed yarn 5 can easily follow the air stream being sucked towards the spinning rotor, whereby a timed back-feeding of the yarn is achieved.

Figure 3:
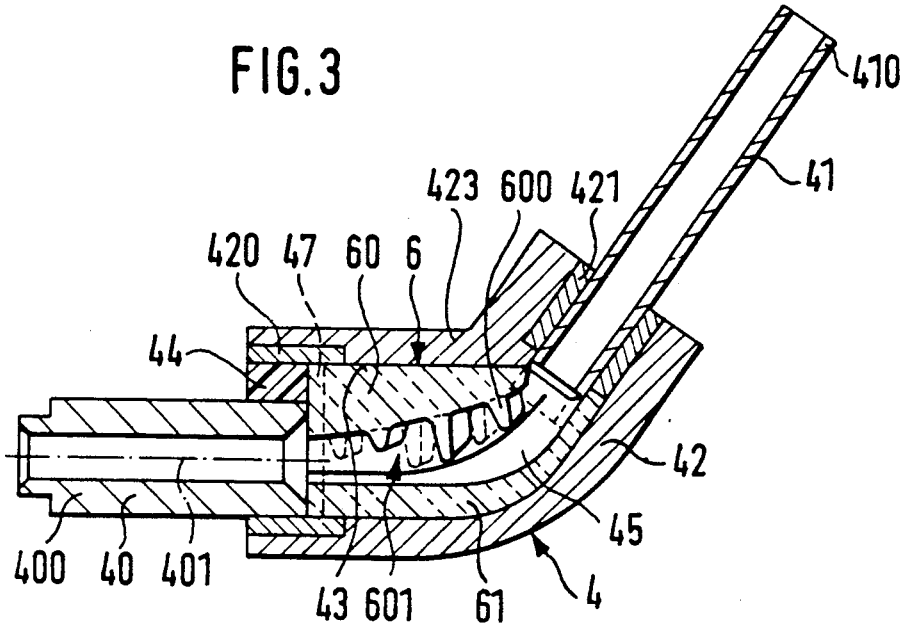
FIG. 3 shows a cross-sectional view of the preferred embodiment of the yarn draw-off pipe, according to the invention.

As is indicated by a broken line in FIG. 3, insert 6 of different configurations, e.g. with edges 600 or ribs of different heights can be used so that the ribs or edges 600 reach more or less distance into chamber 45, which is made possible through the fact that chamber 45 widens accordingly and provides the necessary free space to accommodate ribs or edges 600 of different heights or different curves of the wall of insert 6 which constitutes the inside of chamber 45.

In principle, insert 6 can be made of any kind of material. It has been shown to be especially advantageous in the field of textile machines to use a ceramic material to make such elements which come into contact with fiber material or with the yarn 5.

According to FIG. 1, a one-piece insert 6 is provided, constituting only a portion of the inner circumferential wall of chamber 45 and leaves the remaining circumferential wall of chamber 45 free. As seen in FIG. 3, insert 6 can also consist of a first partial insert 60 with the deflection surface, and of an additional partial insert 61 which, together, close chamber 45.

In principle, one single transverse rib or edge 600 is sufficient for insert 6, but a propagation of twist in direction of pipe section 41 can be modified even more easily if several transverse ribs or edges 600 are installed one behind the other. For this reason, FIG. 1 shows an insert 6 with a plurality of transverse ribs or edges 600 protruding into the path of the yarn. As a rule, these transverse ribs or edges 600 do not extend simply transversely to the direction of yarn movement, but are also positioned obliquely in their relation to it, this position is determined as a function of the direction of twist of the spinning rotor 1 (see FIG. 1). This oblique position makes it possible to dam up the twist which builds up in the yarn segment in the zone of the first pipe section 40 even more effectively, the twist being thus propagated back into the spinning element.

The edges 600 can have different configurations and, depending on the effect desired, can have more or less effect upon yarn 5. This can be achieved through the relative arrangement of pipe sections 40 and 41 and, of insert 6. This can also be achieved by means of an appropriate profile of the deflection surface 601. If at least one transverse rib or edge 600 is provided, it can be made relatively narrow-edged or markedly rounded off. Furthermore, the effect upon yarn 5 can be varied by varying the roughness of the deflection surface 601 or of its transverse ribs or edges 600. In this manner, the propagation of twist into the spinning element (which is made in form of a spinning rotor 1 in the embodiment shown in FIG. 1) as well as the hairiness and the handle of the finished yarn 5 can be influenced.

As FIG. 1 shows, the position of insert 6 is fixed by means of the two pipe sections 40 and 41 since insert 6 is applied on both sides against pipe sections 40 and 41. Pipe sections 40 and 41 are detachable so that each of the connecting piece 42, and pipe sections 40 and 41 can be replaced individually when necessary.

Pipe sections 40 and 41 can be connected in any manner desired to the connecting piece 42, e.g. by soldering or gluing. In the embodiment shown in FIG. 3, however, both are supported in the connecting piece 42, which in this case could be made of plastic, by means of sleeves 420 and 421 which are made of metal. This or other designs, e.g. that shown in FIG. 1, in which the pipe sections 40 and 41 are supported in connecting piece 42, are especially well suited since this provides the conditions for additional adjustability of the insert 6 in the connecting piece 42.

FIG. 3 illustrates an embodiment of a yarn draw-off pipe 4 in which the degree of the effect which insert 6 has on yarn 5 can be changed by changing the relative position of insert 6 and pipe section 41. In this embodiment, the two pipe sections 40 and 41 are also supported in the connecting piece 42. The latter is provided with a guide 43 extending in the longitudinal direction and parallel to axis 401 of the first pipe section 40 into which bore wall 423 of the connecting piece 42, receiving the second pipe section 41, lets out. By pulling the pipe section 41 minimally out of bore 422 and by pushing insert 6 to follow, the effective angle of insert 6 can be modified. Axial immobilization of the insert 6 is effected by pipe section 40 which is pushed to follow so that it remains in contact with insert 6 (possibly with a spacer ring 47 being shown in a broken line, being interposed). In order to provide sufficient radial space required for the axial adjustment of the insert, the chamber 45 is radially widened in the longitudinal section of insert 6. As an alternative, an insert 6 of different length could also be used, as is indicated in FIG. 3 by broken lines, whereby the different lengths are compensated through the axial shifting of the pipe section 40 or by means of an inserted ring 47.

Figure 4:
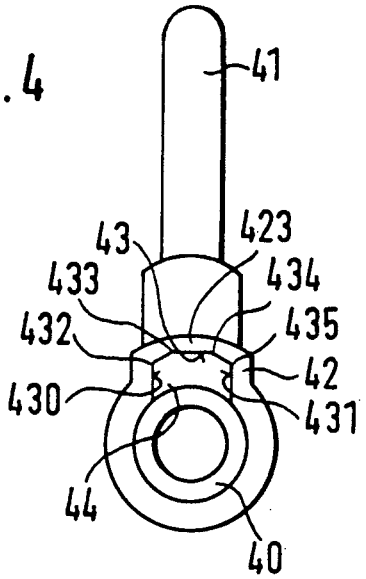
FIG. 4 shows a front view of the yarn draw-off pipe, shown in FIG. 3, as seen from the spinning device.

To make it possible for insert 6 to assume a predetermined rotational position in relation to the path of the yarn, insert 6 is secured against rotation. As shown in FIG. 4, guide 43 has an appropriate cross-section within connecting piece 42, e.g. with two parallel lateral walls 430 and 431.

Once the insert 6 has been placed in its desired relative position within the connecting piece 42, it can be fixed in it in such manner that it is permanently connected to the connecting piece 42, and possibly, also, to the pipe sections 40 and 41. If desired, it can also be supported in connecting piece 42 so as to be capable of being replaced, so that it can be taken out of connecting piece 42, after removal of the pipe section 40, to be replaced by a new or different insert 6. Adjustment of insert 6 to adapt it to other requirements is also possible when said insert 6 is supported so that it can be replaced.

To be able to deflect yarn 5 over a greater angle in connecting piece 42, without the deflection radius becoming too small, it is necessary for insert 6 to be of a certain length. For this purpose, according to FIGS. 1 to 4, insert 6 does not end radially with the outside diameter of the first pipe section 40 but extends radially beyond the outside diameter of the first pipe section 40 at its end towards the spinning device (e.g. spinning rotor 1). In order for the connecting piece 42 not to take up too much space, this first pipe section is installed eccentrically in relation to the connecting piece, as shown in FIGS. 3 and 4.

In the embodiment shown in FIG. 1, insert 6 reaches as far as the outside of the connecting piece 42. To prevent air from penetrating into the interior of connecting piece 42, due to manufacturing tolerances between insert 6 and guide 43, guide 43 is limited on its side away from the path of the yarn by a wall 423 of the connecting piece, 42 in the embodiment shown in FIGS. 3 and 4. To secure insert 6 against rotation, guide 43 has a polygonal cross-section with several guiding edges 432, 433, 434 and 435 (see FIG. 4).

In order to avoid unnecessary projecting edges and cavities to which fly could adhere, the area of guide 43 left free by insert 6 is filled up with a plastic material 44, according to FIG. 3. In principle any type of plastic material can be used, but a plastic material capable of being cured is especially advantageous because it serves at the same time to secure the individual elements of the yarn draw-off pipe 4 in relation to each other.

As the above description shows, the yarn draw-off pipe 4 can be modified in different ways, especially by replacing individual elements, by equivalents, or through different combinations. Thus, it is not required for the inside cross-section of the yarn draw-off pipe 4, from the inlet 400 to the inlet end of pipe section 41 to remain constant, but this cross-section may become larger, as FIG. 3 shows, if this appears to be advisable for manufacturing and other reasons.

Neither is it absolutely necessary for the insert 6 to extend from pipe section 40 to pipe section 41. Instead, the intake opening 46 into which insert 6 is inserted, can go over into a smaller bore (not shown) which is still part of chamber 45 and into which pipe section 41 ends. In this case, insert 6 is attached axially between the front end of the insertion opening 46 and the pipe section 41.

The yarn draw-off pipe 4 can be used with open-end spinning devices of different types and, is not limited to devices with a spinning rotor 1. Thus, it is also possible to use such yarn draw-off pipes 4 in combination with friction spinning devices.

What is claimed is:

1. A yarn drawn-off pipe for guiding yarn from a yarn spinning device to a yarn take-up device, such yarn spinning device having a covering with an opening therein, comprising:

(a) a first pipe section connected to said yarn spinning device and received in said yarn spinning device covering opening for receiving and guiding said yarn through said covering opening;

(b) a second pipe section spaced from, and disposed with its longitudinal axis at an angle to, the longitudinal axis of said first pipe section, for guiding said yarn in a direction towards said take-up device;

(c) a connecting piece comprising a chamber including means for connecting said first and second pipe sections in adjustably fixed axial relationship, having a smooth arcuate surface for guiding said yarn from said first pipe to said second pipe when said yarn is blown through said draw-off pipe, said connecting piece being supported on said first pipe section;

(d) an insert adjustably associated in fixed axial relationship with said connecting piece and having a yarn deflection surface which extends into said chamber and comprises a yarn guiding surface for contacting said yarn as said yarn is pulled through said draw-off pipe; and (e) means for directing said yarn from said second pipe to said take-up device;

wherein said insert may be adjusted in its fixed axial position or replaced without removing said first pipe section from said covering opening.

2. A yarn draw-off pipe as set forth in claim 1, wherein said connecting piece defines an opening in one side thereof for receiving said insert.

3. A yarn draw-off pipe as set forth in claim 1, wherein said chamber is enlarged in its longitudinal area adjacent said insert and said insert is movable in an axial direction to modify its relative position in relation to at least one of said pipe sections.

4. A yarn draw-off pipe as set forth in claim 1, wherein said chamber is enlarged in its longitudinal area adjacent said insert and said insert may be replaceable by an insert having a different length.

5. A yarn draw-off pipe as set forth in claim 1, wherein said chamber is enlarged adjacent to said insert and said insert is adjustable to extend a variable distance into said chamber.

6. A yarn draw-off pipe as set forth in claim 1, further including a guide extending in the longitudinal direction of said connecting piece for receiving said insert and securing same against rotation.

7. A yarn draw-off pipe as set forth in claim 6, wherein said guide extends parallel to the longitudinal axis of said first pipe section.

8. A yarn draw-off pipe as set forth in claim 6, wherein said guide is disposed in the wall of said connecting piece away from the path of the yarn.

9. A yarn draw-off pipe as set forth in claim 8, wherein said guide has a polygonal cross-section.

10. A yarn draw-off pipe for guiding yarn from a yarn spinning device to a yarn take-up device, comprising:

(a) a first pipe section emerging from said yarn spinning device and disposed to receive yarn from said yarn spinning device and guide said yarn along the longitudinal axis of said first pipe section;

(b) a second pipe section disposed with its longitudinal axis at an angle to the longitudinal axis of said first pipe section for guiding said yarn in a direction at a angle to said first pipe section longitudinal axis;

(c) a connecting piece associated with said first pipe section and comprising a chamber for guiding said yarn from said first pipe section to said second pipe section and further comprising means for associating said first and second pipe sections in adjustably fixed axial relationship;

(d) an insert adjustably associated with said connecting piece for selected fixed positioning thereof relative said first and second pipe sections and having a yarn deflection surface which extends into said chamber and provides a yarn guiding surface within said chamber for contacting said yarn as said yarn is drawn through said draw-off pipe; and (e) means for directing said yarn from said second pipe section to said take-up device;

wherein said insert is supported relative to said yarn spinning device so as to readily be repositioned relative to said first and second pipe sections or replaced.

11. A yarn draw-off pipe as set forth in claim 10, wherein said connecting piece has an opening in one side of said chamber for receiving said insert.

12. A yarn draw-off pipe as set forth in claim 10, wherein said chamber is enlarged in its longitudinal area adjacent said insert and said insert is movable in an axial direction to modify its relative position in relation to at least one of said pipe sections.

13. A yarn draw-off pipe as set forth in claim 10, wherein said chamber is enlarged in its longitudinal area adjacent said insert and said insert may be replaceable by an insert having a different length.

14. A yarn draw-off pipe as set forth in claim 10, wherein said chamber is enlarged adjacent to said insert and said insert is adjustable to extend a variable distance into said chamber.

15. A yarn draw-off pipe as set forth in claim 10, wherein at the inner walls of said chamber are essentially a continuation of the inner walls of said first and second pipe sections.

16. A yarn draw-off pipe as set forth in claim 10, wherein said insert is comprised of a ceramic material.

17. A yarn draw-off pipe as set forth in claim 10, wherein said deflection surface of said insert is provided with at least one edge which extends into said chamber.

18. A yarn draw-off pipe as set forth in claim 17, wherein said edge extends obliquely relative to the path of said yarn.

19. A yarn draw-off pipe as set forth in claim 10, wherein said pipe sections are supported within said connecting piece.

20. A yarn draw-off pipe as set forth in claim 10, wherein said connecting piece is composed of a plastic material and provided with sleeves made of metal for receiving said first and second pipe sections, each of said sleeves receiving one end of said insert.

21. A yarn draw-off pipe as set forth in claim 10, wherein only a portion of the interior walls of said chamber is constituted by said insert.

22. A yarn draw-off pipe as set forth in claim 21, wherein said insert is secured against rotation within said connecting piece by a guide extending in the longitudinal direction of said connecting piece.

23. A yarn draw-off pipe as set forth in claim 22, wherein said guide extends parallel to the longitudinal axis of said first pipe section.

24. A yarn draw-off pipe as set forth in claim 23, wherein an end of said insert closer to said yarn spinning device protrudes radially beyond the outside diameter of said first pipe section.

25. A yarn draw-off pipe as set forth in claim 24, wherein said first pipe section is disposed eccentrically with relation to said connecting piece.

26. A yarn draw-off pipe as set forth in claim 23, wherein the area between said insert and the end face of said connecting piece which is nearer said yarn spinning device is filled with a plastic material.

27. A yarn draw-off pipe as set forth in claim 26, wherein said plastic material is thermosetting.

28. A yarn draw-off pipe as set forth in claim 22, wherein said guide is disposed in the wall of said connecting piece away from the path of the yarn.

29. A yarn draw-off pipe as set forth in claim 28, wherein said guide has a polygonal cross-section.

30. A yarn draw-off pipe for guiding yarn from a yarn spinning device to a yarn take-up device, comprising:

(a) a first pipe section connected to said yarn spinning device for receiving and guiding said yarn in a yarn withdrawal direction;

(b) a second pipe section spaced from, and disposed with its longitudinal axis at an angle to the longitudinal axis of said first pipe section for guiding said yarn in a yarn delivery direction;

(c) a connecting piece comprising a chamber forming therein means for connecting said first and second pipe sections in adjustably fixed axial relationship relative one another, having a smooth arcuate surface for guiding said yarn from said first pipe to said second pipe when said yarn is returned through said draw-off pipe;

(d) an insert having a yarn deflection surface extending into said chamber in a fixed axially adjustable position and comprising a yarn guiding surface for contacting said yarn as said yarn is pulled through said draw-off pipe, said insert having end faces which contact the end faces of said first and second pipe sections in a manner such that said insert is adjustably axially fixed by said first and second pipe sections in an adjustable axial position determined by said means for connecting.

31. A yarn draw-off pipe as set forth in claim 30, wherein said insert and one of said first and said second pipe sections are movable in the longitudinal direction of this one pipe section and the other of said first and second pipe sections is movable in its longitudinal direction in such a way that after performance of such shifting movements of said first and second pipe sections and of said insert, the latter is axially fixed by said first and second pipe sections.

32. A yarn draw-off pipe as set forth in claim 30, wherein said insert and one of said first and said second pipe sections are movable received in a longitudinal direction in said connecting piece, and said yarn draw-off pipe further includes at least one ring insertable between said insert and one or both of said first and second pipe sections so that inserting of said at least one ring axially fixes said insert and said first and second pipe sections after longitudinal adjustment thereof.

33. A yarn draw-off pipe as set forth in claim 30, wherein said connecting piece has an opening in one side of said chamber for receiving said insert.

34. A yarn draw-off pipe as set forth in claim 30, wherein said chamber is enlarged in a longitudinal area thereof adjacent said insert and said insert is movable in an axial direction to modify its relative position in relation to at least one of said pipe sections.

35. A yarn draw-off pipe as set forth in claim 30, wherein said chamber is enlarged in a longitudinal area thereof adjacent said insert which insert is replaceable with another insert having a different length.

36. A yarn draw-off pipe as set forth in claim 30, wherein said chamber is enlarged adjacent to said insert, which insert is adjustable for extending a variable distance into said chamber.

37. A yarn draw-off pipe as set forth in claim 30, wherein inner walls of said chamber essentially comprise an effective continuation of inner walls of said first and second pipe sections.

38. A yarn draw-off pipe as set forth in claim 30, wherein said insert is comprised of a ceramic material.

39. A yarn draw-off pipe as set forth in claim 30, wherein said deflection surface of said insert is provided with at least one edge which extends into said chamber.

40. A yarn draw-off pipe as set forth in claim 39, wherein said at least one edge extends obliquely relative to the path of yarn therethrough.

41. A yarn draw-off pipe as set forth in claim 30, wherein said pipe sections are supported within said connecting piece.

42. A yarn draw-off pipe as set forth in claim 41, wherein said connecting piece is composed of a plastic material, and is provided with sleeves made of metal for receiving said first and second pipe sections, each of said sleeves receiving one end of said insert.

43. A yarn draw-off pipe as set forth in claim 30, wherein only a portion of the interior walls of said chamber is constituted by said insert.

44. A yarn draw-off pipe as set forth in claim 43, wherein said insert is secured against rotation within said connecting piece by a guide extending in the longitudinal direction of said connecting piece.

45. A yarn draw-off pipe as set forth in claim 44, wherein said guide extends parallel to the longitudinal axis of said first pipe section.

46. A yarn draw-off pipe as set forth in claim 45, wherein said insert protrudes radially beyond the outside diameter of said first pipe section.

47. A yarn draw-off pipe as set forth in claim 46, wherein said first pipe section is disposed eccentrically with relation to said connecting piece.

48. A yarn draw-off pipe as set forth in claim 46, wherein the area between said insert and the end face of said connecting piece which is nearer said yarn spinning device is filled with a plastic material.

49. A yarn draw-off pipe as set forth in claim 48, wherein said plastic material is thermosetting.

50. A yarn draw-off pipe as set forth in claim 44, wherein said guide is disposed in the wall of said connecting piece away from the path of the yarn.

51. A yarn draw-off pipe as set forth in claim 50, wherein said guide has a polygonal cross-section.

52. A yarn draw-off pipe for guiding yarn from a yarn spinning device to a yarn take-up device, comprising:

(a) a first pipe section disposed to receive yarn from said yarn spinning device and for guiding said yarn in a yarn withdrawal direction;

(b) a second pipe section disposed with its longitudinal axis at an angle to the longitudinal axis of said first pipe section for guiding said yarn in a yarn delivery direction at an angle to said yarn withdrawal direction;

(c) a connecting piece comprising a chamber for guiding said yarn from said first pipe section to said second pipe section, said connecting piece including means for supporting said first and second pipe sections at an angle to each other and at adjustably fixed axial displacement thus forming an inner longer and an inner shorter bow portion, said inner shorter bow portion having a stepped section, the thereby formed stepped section forming a stop face;

(d) an insert having a yarn deflection surface which extends into said chamber and provides a yarn guiding surface within said chamber for contacting said yarn as said yarn is drawn through said draw-off pipe, said insert having end faces which contact the end face of one of said first and second pipe sections and said stop face in such a manner that said insert is adjustably axially fixed by said end face and said stop face in a selected fixed axial position determined by the adjustably fixed axial displacement of the pipe sections effected by said connecting piece means for supporting.

53. A yarn draw-off pipe as set forth in claim 52, wherein said insert and said one of said first and said second pipe sections are movably received in a longitudinal direction in said connecting piece, and said yarn draw-off pipe further includes at least one ring insertable between said end face of said one of said first and said second pipe sections and said insert and/or said insert and said stop face so that inserting of said at least one ring axially fixes said one of said first and second pipe sections and said stop face after longitudinal adjustment thereof.

54. A yarn draw-off pipe for guiding yarn from a yarn spinning device to a yarn take-up device, comprising:

a pipe section for guiding said yarn in a direction towards said take-up device;

a mounting piece for supporting said pipe section and comprising a chamber defining an opening for receiving and guiding said yarn in one direction, the longitudinal axis of said opening being arranged at an angle to the longitudinal axis of said pipe section, said chamber further defining a smooth arcuate surface for guiding said yarn from said pipe section to said opening when said yarn is returned towards said yarn spinning device; and an insert supported on said mounting piece and having a yarn engaging surface which extends into said chamber and comprises a yarn guiding surface for contacting said yarn as said yarn is pulled through said draw-off pipe;

wherein said mounting piece includes adjustment means for adjustably supporting said insert for selected fixed axial displacement of said yarn guiding surface in said chamber, so that the axial location of such surface relative said draw-off pipe is adjustably fixed.

55. A yarn draw-off pipe as set forth in claim 54, wherein said mounting piece has an opening in one side of said chamber for receiving said insert.

56. A yarn draw-off as set forth in claim 54, wherein said chamber is enlarged in its longitudinal area adjustment said insert and said insert is movable in an axial direction to modify the relative position of said yarn guiding surface in relation to said pipe section.

57. A yarn draw-off pipe as set forth in claim 54, wherein said chamber is enlarged in its longitudinal area adjacent said insert and said insert may be replaceable by an insert having a different length.

58. A yarn draw-off pipe as set forth in claim 54, wherein said pipe section is axially displaceable in said connecting piece, whereby said pipe section may be adjusted so as to be in contact with said insert.

59. A yarn draw-off pipe as set forth in claim 54, wherein a further pipe section is connected to said opening of said mounting piece.

60. A yarn draw-off pipe as set forth in claim 54, wherein the inner walls of said chamber essentially comprise a continuation of the inner walls of said pipe section.

61. A yarn draw-off pipe as set forth in claim 54, wherein said insert is comprised of a ceramic material.

62. A yarn draw-off pipe as set forth in claim 54, wherein said insert yarn engaging surface comprises a deflection surface provided with at least one edge which extends into said chamber.

63. A yarn draw-off pipe as set forth in claim 62, wherein said edge extends obliquely relative to the path of said yarn.

64. A yarn draw-off pipe as set forth in claim 54, wherein said pipe section is supported within said mounting piece.

65. A yarn draw-off pipe as set forth in claim 64, wherein said mounting piece is composed of a plastic material and provided with a sleeve made of metal for receiving said pipe section and one end of said insert.

66. A yarn draw-off pipe as set forth in claim 54, wherein said insert comprises a portion of the interior walls of said chamber.

67. A yarn draw-off pipe as set forth in claim 66, wherein said insert is secured against rotation within said connecting piece by a guide extending in the longitudinal direction of said connecting piece.

68. A yarn draw-off pipe as set forth in claim 67, wherein a further pipe section is connected to said opening of said mounting piece and wherein said guide extends parallel to the longitudinal axis of said further pipe section.

69. A yarn draw-off pipe as set forth in claim 68, wherein an end of said insert closer to said yarn spinning device protrudes radially beyond the outside diameter of said further pipe section.

70. A yarn draw-off pipe as set forth in claim 69, wherein said further pipe section is disposed eccentrically with relation to said connecting piece.

71. A yarn draw-off pipe as set forth in claim 69, wherein the area between said insert and the end face of said mounting piece which is nearer said yarn spinning device is filled with a plastic material.

72. A yarn draw-off pipe as set forth in claim 71, wherein said plastic material is thermosetting.

73. A yarn draw-off pipe as set forth in claim 67, wherein said guide is part of the wall of said mounting piece.

74. A yarn draw-off pipe as set forth in claim 73, wherein said guide has a polygonal cross-section.

* * * * *